US006129365A

United States Patent [19]

Sadow

[11] Patent Number: 6,129,365

[45] Date of Patent: Oct. 10, 2000

[54] INCLINED HANDLE FOR WHEELED CASE

[75] Inventor: Bernard David Sadow, Chappaqua, N.Y.

[73] Assignee: Outrigger, Inc., Chappaqua, N.Y.

[21] Appl. No.: 09/003,842

[22] Filed: Jan. 7, 1998

Related U.S. Application Data

[63] Continuation-in-part of application No. 08/886,301, Jul. 1, 1997, Pat. No. 5,868,406.

[51] Int. Cl.[7] ..... B26B 1/00

[52] U.S. Cl. ..... 280/47.26; 280/47.315; 280/655; 280/655.1; 280/47.29; 280/37; 190/18 A; 190/115; 16/114 R

[58] Field of Search ..... 280/47.26, 47.29, 280/47.315, 655, 655.1; 190/18 A, 115; 135/67, 68, 130, 138, 144; 16/114 R

[56] References Cited

U.S. PATENT DOCUMENTS

| | | | |
|---|---|---|---|
| 2,883,731 | 4/1959 | Wells | 280/47.26 |
| 4,966,379 | 10/1990 | Mulholland | 280/242.1 |
| 5,048,649 | 9/1991 | Carpenter et al. | 190/18 A |
| 5,197,579 | 3/1993 | Bieber et al. | 190/18 A |
| 5,547,053 | 8/1996 | Liang | 190/115 |
| 5,573,027 | 11/1996 | Hsiung | 135/142 |
| 5,630,521 | 5/1997 | Waddell et al. | 190/18 A |
| 5,653,319 | 8/1997 | Wang | 190/115 |
| 5,842,495 | 12/1998 | Egnew et al. | 135/133 |
| 5,868,406 | 2/1999 | Sadow | 280/47.26 |

*Primary Examiner*—Brian L. Johnson
*Assistant Examiner*—Deanna Draper
*Attorney, Agent, or Firm*—Abelman, Frayne & Schwab

[57] ABSTRACT

An inclined handle structure for a wheeled case comprises an inclined handle attached at a fixed angle with respect to a wall of the wheeled case. The inclined handle retracts toward and extends from the wall of the wheeled case while being held in a guide which is fixedly attached to the wheeled case. The wheeled case can be tipped on its wheels and pushed or pulled by means of the inclined handle. Alternatively, if the wheeled case has sufficient wheels the case can be pushed or pulled in an upright position by the inclined handle.

18 Claims, 8 Drawing Sheets

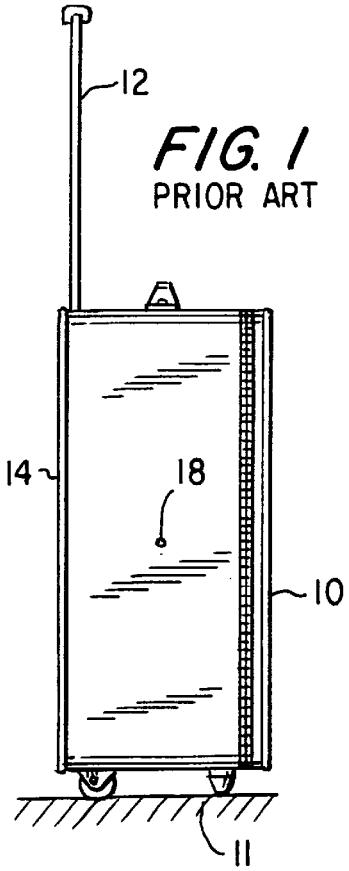
FIG. 1
PRIOR ART
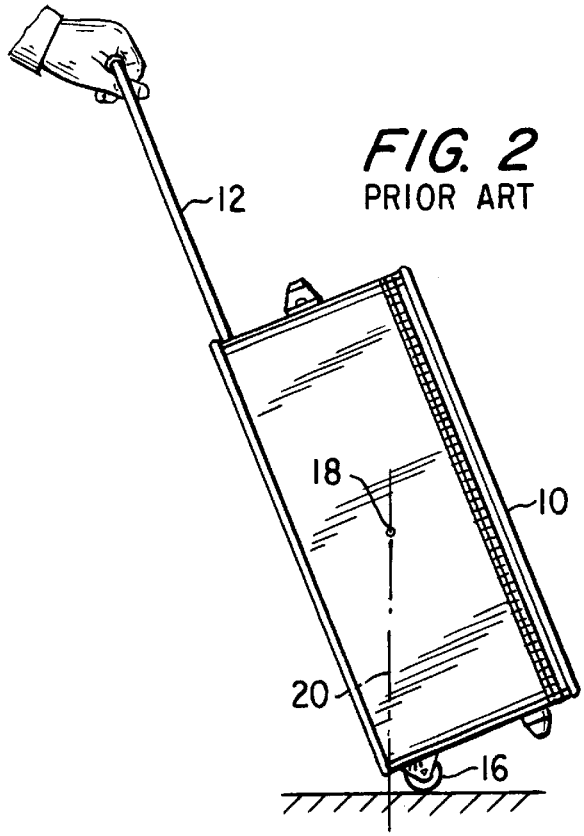
FIG. 2
PRIOR ART
FIG. 3
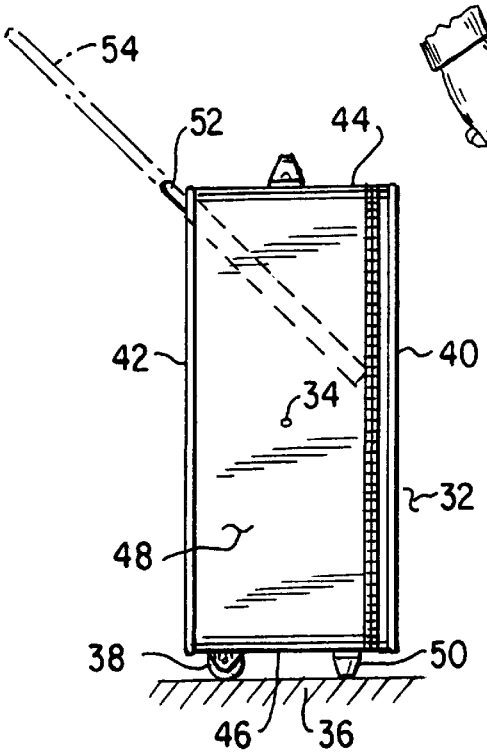
FIG. 4
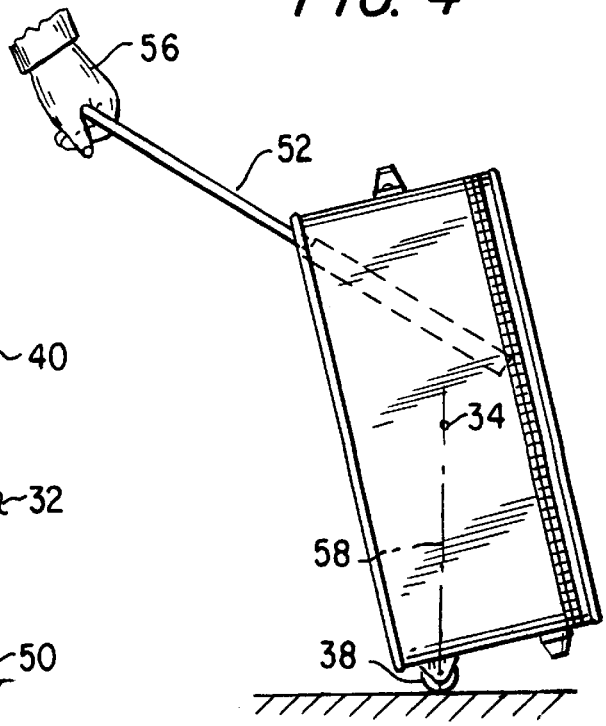

FIG. 11C
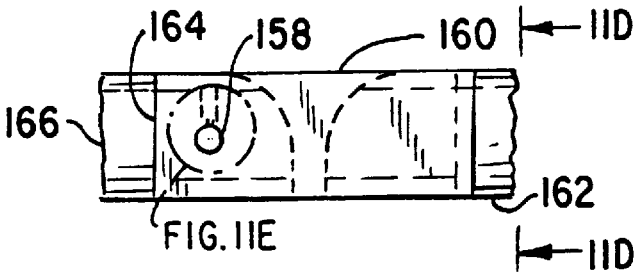
FIG. 11D
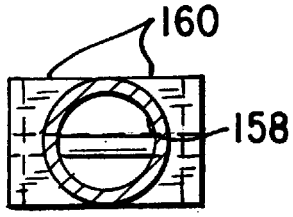
FIG. 11E
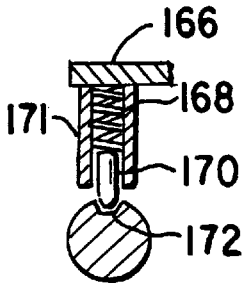
FIG. 11F
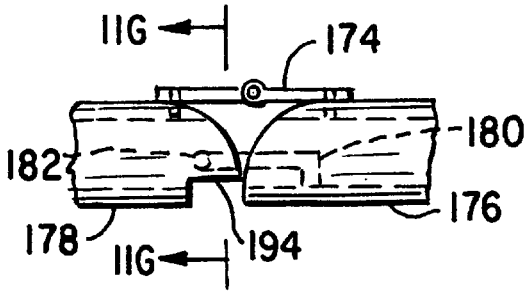
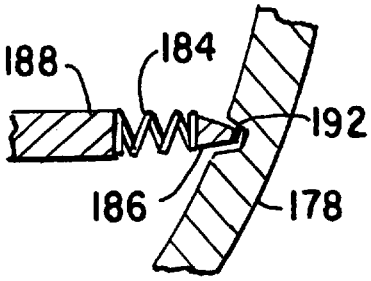
FIG. 11H
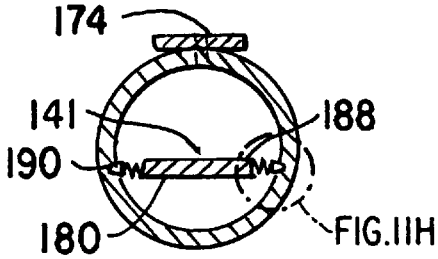
FIG. 11G

INCLINED HANDLE FOR WHEELED CASE

CROSS-REFERENCE TO RELATED APPLICATION

This application is a continuation-in-part of application Ser. No. 08/886,301, filed on Jul. 1, 1997, now U.S. Pat. No. 5,868,406.

BACKGROUND OF THE INVENTION

1. Field of the Invention

This invention relates to a case or luggage that may be wheeled in any one of the four directions parallel to the front, rear, and two side walls of the case or luggage and, in particular, to handles attached to such luggage to effect such wheeling.

2. Description of the Related Art

A case or luggage of a generally parallelepiped shape has six walls, namely, a top wall, bottom wall, front wall, rear wall, and two side walls and may have wheels or other rolling members placed on the bottom wall of the luggage to permit wheeling the luggage in any one or more of four directions parallel to the front, rear, and two side walls. Typically, to wheel the luggage in any two collinear directions parallel to either the front and rear walls or the two side walls a handle, which preferably is mounted in the interior of the case and extends out to its full length, is used. The handle is normally mounted so that it is substantially parallel to one of the walls of the case. However, such an arrangement produces a handle the top part of which is relatively high and difficult for users to grasp even when the case is in a tipped position in which it is typically pulled or pushed by the user.

In order to relieve the user's discomfort, a handle inclined at an angle to the wall of the case on which the handle is mounted will result in a handle whose top grasping surface is less elevated from a supporting surface for the case than a conventional parallel handle of equivalent length. The inclined handle will also allow the user to push or pull the case at a range of angles to the surface with increased rotational stability over that possible with a conventional parallel handle.

The most closely related art of which the applicant is aware is Waddell et al., U.S. Pat. No. 5,630,521. That patent generally discloses a case with an inclined handle, but requires that the case be trapezoidal or be supported by wheels giving it a tilt in the upright position so that in either event the case is not perpendicular to the supporting surface when it is upright. Such a configuration of the case or its supports will increase the difficulty of stowing it in baggage compartments in airplanes, buses, automobiles, or other means of transport and will increase the effective space occupied by the case in such compartments. The present invention retains the conventional rectangular cross-section of luggage and, thus, is not subject to this disadvantage of Waddell et al.

SUMMARY OF THE INVENTION

The invention comprises an inclined handle structure for a wheeled case or other wheeled luggage which increases the comfort of the user and results in better rotational stability of the case while it is being rolled than available for a conventional parallel handle.

A first embodiment of the invention comprises an inclined handle structure mounted in the portion of a partially wheeled case furthest from a supporting surface on which the wheels rest. The inclined handle structure comprises two tubes fixedly mounted at an angle between the horizontal and the vertical on the interior of the side walls of the case. The legs of a U-shaped telescoping handle are mounted in the tubes so that the handle can be extended and retracted. The top element of the U-shaped telescoping handle spanning between the legs of the U-shaped telescoping handle is coplanar with the legs. When a cross-section of the case is taken either perpendicularly to the front and rear walls or to the side walls, the front and rear walls and the top and bottom walls or the side walls and the top and bottom walls form a substantially rectangular cross-section.

A second embodiment of the invention differs from the first in that the top portion of the U-shaped telescoping handle spanning between the legs is not coplanar with the legs for adjustment purposes to increase the comfort of a particular user.

A third embodiment of the invention replaces the fixed supports on one side of the wheeled case in the first embodiment of the invention with wheels.

A fourth embodiment of the invention differs from the first embodiment in that the legs of the U-shaped telescoping handle are designed to resist breakage if the wheeled case falls to a supporting surface with the U-shaped handle partially or fully extended.

An object of the invention is to provide a means to increase the comfort of a user in rolling his wheeled case or other wheeled luggage by decreasing the height at which the handle of the wheeled case or other wheeled luggage must be grasped.

A further object of the invention is to provide a means to increase the rotational stability of wheeled cases when being rolled by users.

A still further object of the invention is to allow users to wheel their luggage at an increased range of angles to the vertical while decreasing the torque that must be exerted by the users to maintain the rotational stability of their luggage.

These and other objects and advantages of the present invention will become more apparent to those of ordinary skill in the art upon consideration of the attached drawings and the following description of the preferred embodiments which are meant by way of illustration and example only, but are not to be construed as in any way limiting the invention disclosed and claimed herein.

BRIEF DESCRIPTION OF THE DRAWINGS

FIG. 1 is a side elevation view of a prior art case and handle in the vertical position.

FIG. 2 is a side elevation view of a prior art case and handle in a position at an angle to the vertical position such that the center of gravity of the case is in a horizontal position to the rear of the wheels on which the case is supported.

FIG. 3 is a side elevation view of a first embodiment of the invention showing a case and an inclined handle in the retracted position and the extended postion of the inclined handle in dotted lines.

FIG. 4 is a side elevation view of the first embodiment of the invention showing a case and an inclined handle in the extended position, the case being at an angle to the vertical such that the center of gravity of the case is at the same horizontal position as the wheels on which the case is supported.

FIG. 11C is a third detailed embodiment of the portion of FIG. 11 indicated therein.

FIG. 11D is a cross-sectional view of FIG. 11C taken along section lines 11D—11D in FIG. 11C.

FIG. 11E is a detail of an area in FIG. 11C indicated therein.

FIG. 11F is a fourth detailed embodiment of the portion of FIG. 11 indicated therein.

FIG. 11G is a cross-sectional view of FIG. 11F taken along section lines 11G—11G in FIG. 11F.

FIG. 11H is a detail of an area in FIG. 11G indicated therein.

DESCRIPTION OF THE PREFERRED EMBODIMENTS

Figure 2A:
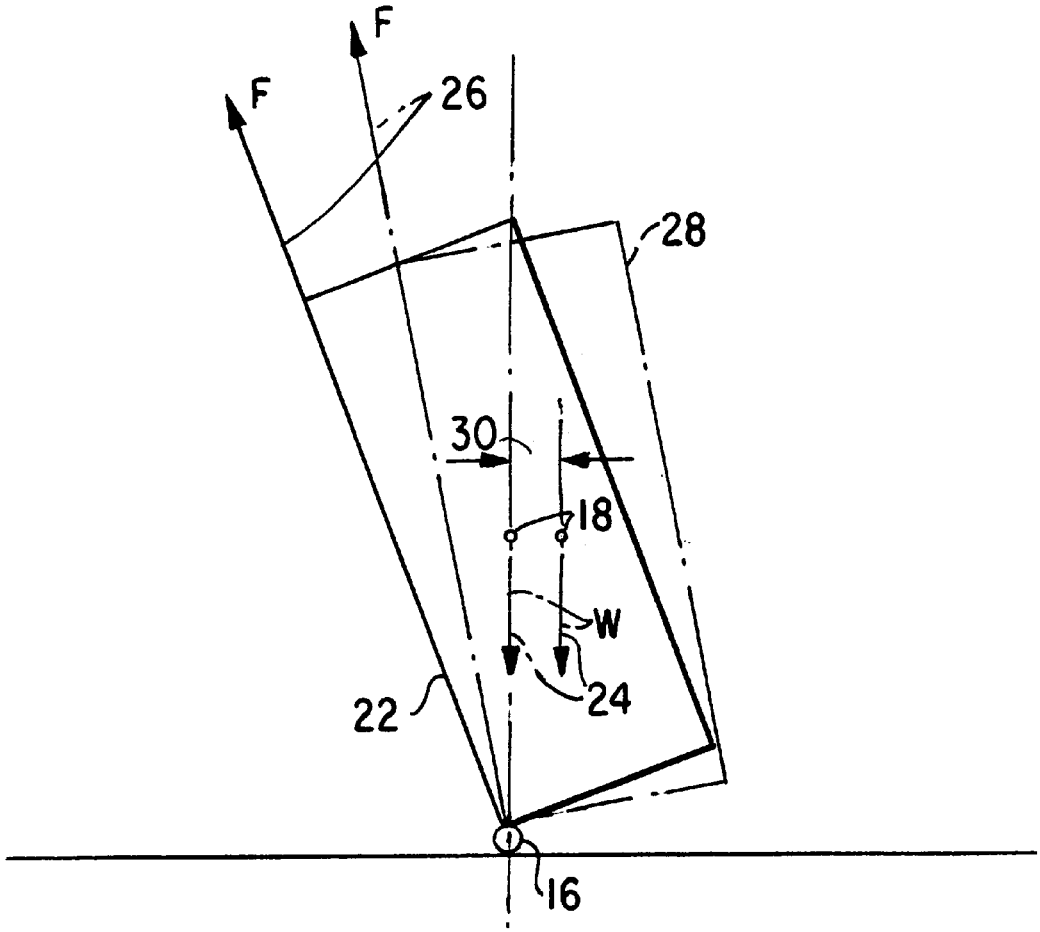
FIG. 2A is a simplified force diagram for a conventional parallel handled case in a tipped position.

For a more detailed description of the invention in its several embodiments, given only by way of example and not to be construed as limiting the invention in any fashion, we refer to the drawings.

In FIG. 1, a wheeled case 10 of a generally parallelepiped shape is shown in a position perpendicular to the surface 11 on which it is supported equipped with a conventional handle 12 which is substantially parallel to the rear wall 14 of the case. FIG. 2 shows the case 10 in a tipped position resting on wheels 16 at the bottom of the case. The center of gravity 18 of the case is in a horizontal position to the rear of the wheels 16 as demonstrated by the vertical dotted line 20 drawn through the center of gravity 18. In this position, the case 10 is rotationally unstable. (In all of the following analysis, the center of gravity of any of the cases shown is always assumed to be in the geometric center of the side of the cases shown which should be reasonable for a fully loaded case.) Indeed, for the conventional parallel handle, any time the horizontal position of the center of gravity 18 is not substantially over the wheels rotational instability results.

This is demonstrated by FIG. 2A which shows a simplified force diagram for the conventional parallel handled case in a tipped position. The position of the case 10 shown in solid lines 22 is such that the horizontal position of the center of gravity 18 is directly over the wheels 16. Thus, the weight of the case, W, 24 falls right over the wheels 16 and exerts zero moment on the wheels 16. Since the line of the force, F, 26 exerted on the handle by the user substantially passes through the wheels 16, we can assume a zero moment arm for this force about the wheels also, and thus zero moment exerted about the wheels 16 by the force, F 26. Thus, there is no net moment exerted about the wheels 16 for this position and rotational stability exists, there being no tendency for the case 10 to rotate about the wheels 16 in this position 22. However, for any other arbitrary angular tipped position of the case 10, symbolized by the dotted lines 28, a net moment about the wheels 16 exists since F 26 still exerts essentially zero moment about the wheels 16, whereas the weight, W, 24 exerts a nonzero moment about the wheels 16 due to the horizontal displacement of the center of gravity 18 from the wheels 16, resulting in a nonzero moment arm distance 30 between W 24 and the wheels 16. This nonzero moment about the wheels 16 makes the case 10 rotationally unstable since it will rotate about the wheels 16 unless the user exerts some counteracting additional force on the handle 12 not directed along the axis of the handle 12 to prevent such rotation. The instant invention improves the rotational stability of the wheeled case over the problematic instability associated with the conventional parallel handle as will be explained below.

FIG. 3 shows a first embodiment of the invention. A wheeled case 32 has a center of gravity 34 and rests on a supporting surface 36 with wheels 38 contacting the supporting surface 36. The wheeled case has a front wall 40, a rear wall 42, a top wall 44, a bottom wall 46, and two side walls 48. A cross-section taken perpendicularly to the front wall 40 and the rear wall 42 will disclose a substantially rectangular cross-section comprised of the front wall 40, the rear wall 42, the top wall 44, and the bottom wall 46. Likewise, a cross-section taken perpendicularly to the two side walls 48 will disclose a substantially rectangular cross-section comprised of the two side walls 48, the top wall 44, and the bottom wall 46. Fixed supports 50 support the side of the case 32 opposite the wheels 38. The inclined handle 52 is shown in the fully retracted position with the fully extended position being shown in dotted lines 54.

FIG. 4 shows the first embodiment of the invention in a tipped position grasped by a user 56. The center of gravity 34 is shown in a horizontal position which is the same as the wheels 38 as demonstrated by the vertical dotted line 58 drawn through the center of gravity 34. The decreased angle of the inclined handle 52 to the horizontal compared to the angle of the parallel handle 12 to the horizontal (see FIG. 2) when both cases 10, 32 are in the tipped position reduces the height at which a user 56 can grip the handle and increases the comfort of the user 56 in rolling the case 32.

Figure 5:
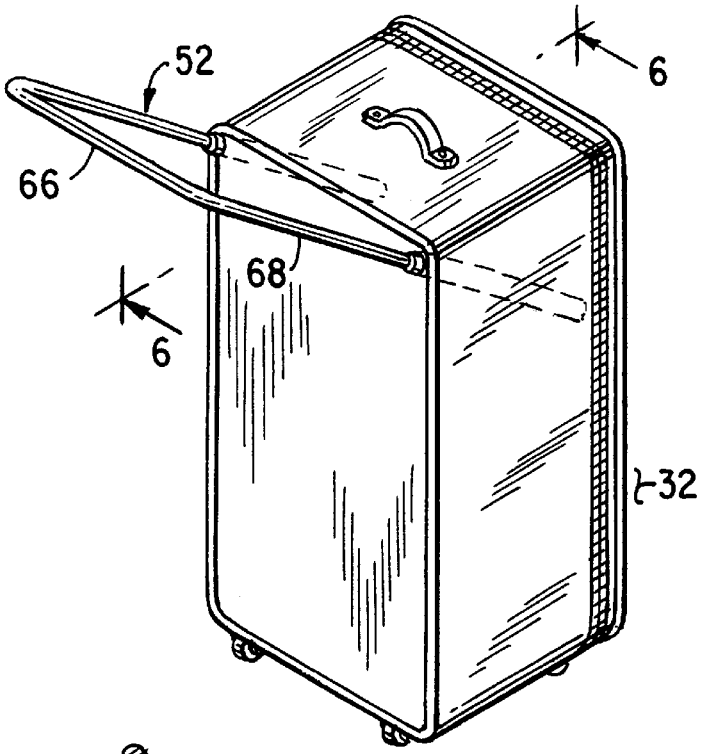
FIG. 5 is a perspective view of the first embodiment of the invention.
Figure 6:
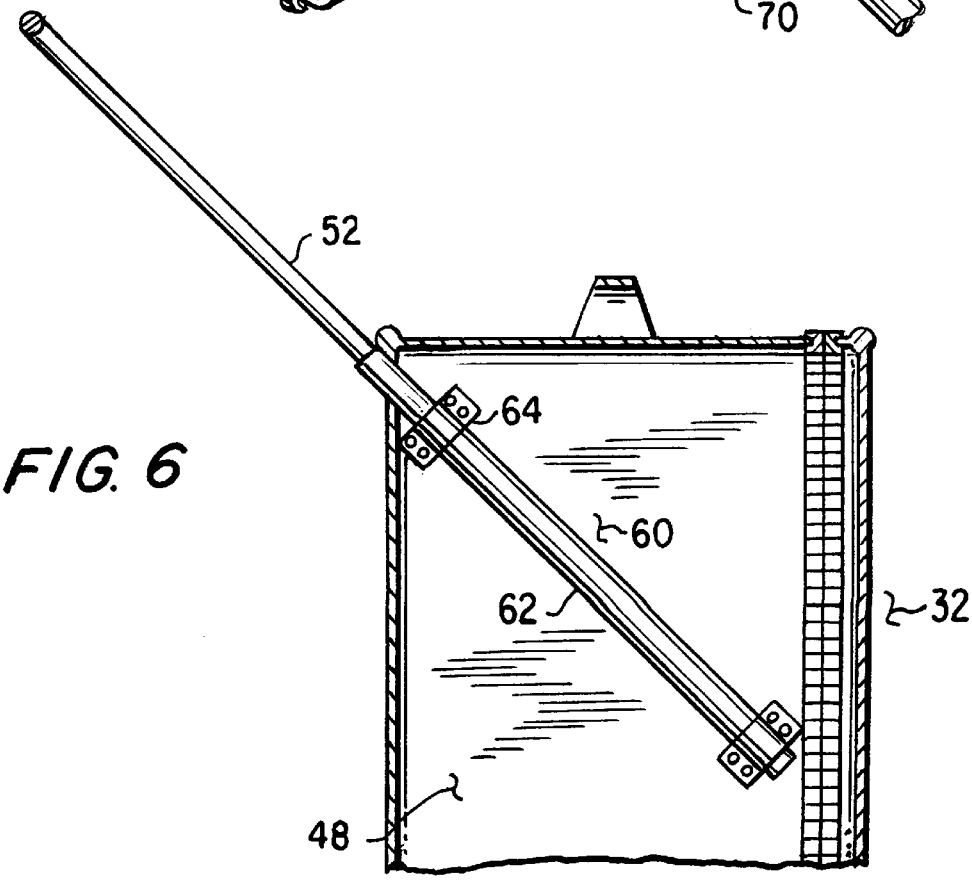
FIG. 6 is a cross-sectional view taken along section lines 6—6 in FIG. 5.

FIG. 5 shows that the inclined handle 52 is U-shaped which is conventional in the art. FIG. 6 illustrates the mounting 60 of the handle 52. The mounting comprises two tubes 62 connected by fixed attachments to the interior of the side walls 48 of the case 32. The position of the mounting tubes 62 as shown in FIG. 6 toward the top of the side walls 48 frees the remainder of the height of the case 32 for the unimpeded storage of clothing or other items. In contrast, in the conventional case 10, the mounting tubes (not shown) of the handle 12 (see FIGS. 1 and 2) in the interior of the case 10 occupy a substantial portion of the rear wall 14 of the case 10, often causing interference with the storage of clothing or other items. The inclined handle 52 slides within the tubes 62 extending to a maximum length outside the case 32 and retracting to a minimum length outside the case 32.

Figure 7:
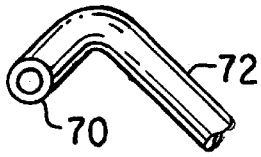
FIG. 7 is a cross-sectional view of the top portion of the inclined handle in a second embodiment of the invention.

FIG. 7 shows the difference in cross-section between a second embodiment of the invention and the first embodiment of the invention. In the first embodiment of the invention, the top portion 66 of the U-shaped inclined handle 52 is coplanar with the legs 68 of the U-shaped inclined handle 52 (see FIG. 5). In the second embodiment of the invention, the top portion 70 of the U-shaped inclined handle 52 is outside the plane of the legs 72 of the handle 52 as an adjustment which may increase the comfort of the user 56 in rolling the case 32.

In general, the inclined handle 52 allows the case 32 to be oriented at any arbitrary angle within a wide range by the user 56, and still remain rotationally stable without an additional force other than axial force being applied to the inclined handle 52 by the user 56, provided that a certain value of force is exerted by the user 56 on the inclined handle 52. In contrast, in the case of the conventional parallel handle 12, rotational stability without application of additional force other than axial force to the handle is only possible when the case 10 is oriented at an angle such that the center of gravity 18 has the same horizontal position as the wheels 16.

To demonstrate these claims of increased rotational stability and to reach some conclusions about the preferable range of angles at which the inclined handle 52 should be set with respect to the case 32, a force analysis must be undertaken.

Figure 8:
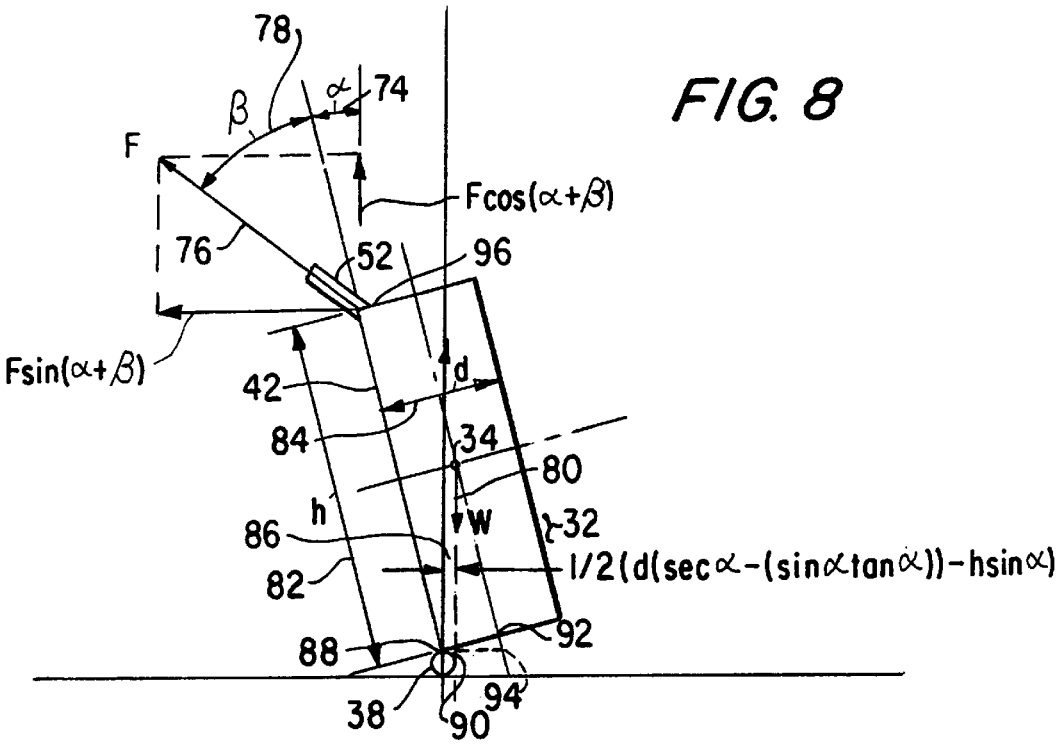
FIG. 8 is a simplified force diagram of an inclined handled case tipped so that the center of gravity of the case is in front of the supporting wheels.

FIG. 8 shows a simplified force diagram for the situation obtaining when case 32 is tipped at an counterclockwise angle, $\alpha$, 74 relative to the horizontal (assumed to be positive; $\alpha=0°$ corresponds to an untipped state which is a limiting condition since the case 32, which has fixed supports 50, cannot be rolled upright) such that the horizontal position of the center of gravity 34 is in front of the wheels 38. (In all calculations below, the simplifying assumption is made that the diameter of the wheels 38 is negligible compared to the other dimensions of the case 32 and, thus, that diameter is ignored. This assumption is reasonable for wheeled cases conventional in the art.) The pulling force F 76 is assumed to be exerted by the user 56 along the axis of the inclined handle 52. The inclined handle 52 is inclined at a counterclockwise angle, $\beta$, 78 (assumed to be positive; $\beta=0°$ corresponds to the condition of a parallel handle) with respect to the rear wall 42 of the case 32. The weight of the case 32, W, 80 acts through the center of gravity 34. The case 32 has a height, h, 82 and a depth, d, 84.

Figure 8A:
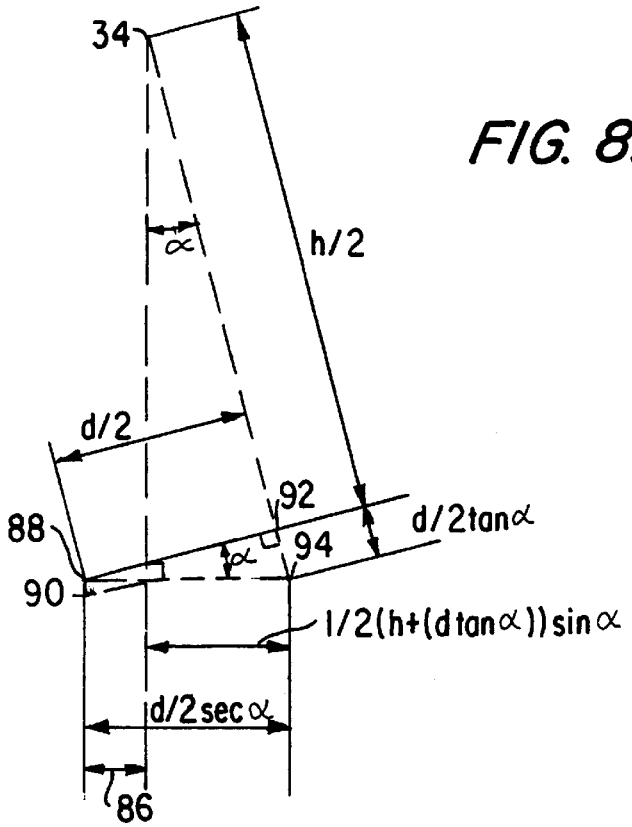
FIG. 8A is an enlargement of a portion of FIG. 8.

The expression for the horizontal distance between the center of gravity 34 and the center of the wheels 38, $\frac{1}{2}[d(\sec\alpha-(\sin\alpha\tan\alpha))-h\sin\alpha]$, 86 was derived by using the similar triangles shown in FIG. 8A which is an enlargement of like similar triangles in FIG. 8. The vertices of the triangles in FIGS. 8 and 8A have been identically labelled 34 (also the center of gravity), 88, 90, 92, 94 to assist a reader of ordinary mathematical skill to follow the derivation from the Figures. For the center of gravity 34 to be in front of the wheels, we require that $\frac{1}{2}[d(\sec\alpha-(\sin\alpha\tan\alpha))-h\sin\alpha]>0$ which simplifies to $d/h>\tan\alpha$.

In order to assure rotational stability about the wheels 38, or in another words to assure that the case 32 does not tip over in either direction while rolling on the wheels, the moments of F 76 and W 80 about the wheels 38 must sum to zero. Expressing this in equation form, we obtain:

$$(F\sin(\alpha+\beta)h\cos\alpha)-(F\cos(\alpha+\beta)h\sin\alpha)-\{W\tfrac{1}{2}[d(\sec\alpha-\sin\alpha\tan\alpha)-h\sin\alpha]\}=0$$

Solving for F 76 and simplifying, we obtain:

$$F=[(W/2)(\cos\alpha)((d/h)-\tan\alpha)]/\sin\beta \quad (1)$$

Assuming that $d/h\leqq 1$, we will have $\alpha<45°$ for the center of gravity in front of the wheels since in that case, $\tan\alpha<d/h$ as previously required. In addition, $\tan\alpha<d/h$ implies that $\alpha<\tan^{-1}(d/h)$ ($\tan^{-1}(d/h)$ is mathematical notation for the inverse tangent of d/h), $\tan^{-1}(d/h)\leqq 45°$ because $d/h\leqq 1$, and we require that $\alpha\geqq 0°$ since all angles of tip, $\alpha$, 74 are assumed to be positive in the counterclockwise direction as previously stated.

The case of $\beta=0°$ is equivalent to the case of the conventional parallel handle, as previously mentioned, so is of little further interest. For any $\beta\neq 0°$, the limiting condition of $\tan\alpha=d/h$ causes F 76 to become zero since this condition is true when the center of gravity 34 is over the supporting wheels 38 and, thus, no restoring force F 76 is required to prevent tipping since the weight, W, 80 exerts no moment about the supporting wheels.

As a matter of practicality and comfort, any user would probably desire the inclined handle 52 to be at least horizontal, or in other words, at an angle such that the grasped end of the handle is at least at the same height as the portion of the handle at the point of attachment to the case 96, regardless of the angle, $\alpha$, at which the luggage is tilted. In other words, the user would desire that $0°<\beta\leqq 90°-\alpha$.

Both of the conditions of $0°<\beta\leqq 90°-\alpha$ and $0°\leqq\alpha<\tan^{-1}(d/h)<45°$ being true imply that $0°<\beta\leqq 90°-\tan^{-1}(d/h)$. For the situation where $0°<\beta\leqq 90°-\tan^{-1}(d/h)$ and $0°\leqq\alpha<\tan^{-1}(d/h)<45°$, it can be seen (1) that F 76 will always be positive, thus validating our original assumption of F 76 as a pulling force. In addition, for a constant $\beta$ 78 in the range of $0°<\beta\leqq 90°-\tan^{-1}(d/h)$ and for $0°\leqq\alpha<\tan^{-1}(d/h)\leqq 45°$, $\alpha=0°$ will produce a greater value of F 76 than any value of $\alpha$ 74 in the remainder of the permissible range of $0°\leqq\alpha<\tan^{-1}(d/h)\leqq 45°$ as may be seen by an inspection of equation (1).

For the condition of $\beta=60°$, equation (1) simplifies to: $F=(W/\sqrt{3})(\cos\alpha)((d/h)-\tan\alpha)$. As $\alpha$ approaches ($\rightarrow$) 0°, $F\rightarrow W/\sqrt{3}(d/h)$ which is approximately equal to ($\approx$) 0.577 W (d/h) and assuming that $d/h\leqq 1$, $F\leqq 0.577$ W for any condition where the case 32 is tipped at a permissible value of $\alpha$ 74, the center of gravity 34 is in front of the supporting wheels 38, and $\beta=60°$ because F 76 is at a maximum for a constant $\beta$ 78 and $\alpha=0°$ as previously stated.

For the condition of $\beta=45°$, equation (1) simplifies to: $F=(W/\sqrt{2})(\cos\alpha)((d/h)-\tan\alpha)$. As $\alpha\rightarrow 0°$, $F\rightarrow W/\sqrt{2}(d/h)\approx 0.707$ W (d/h) and assuming that $d/h\leqq 1$, $F\leqq 0.707$ W for any condition where the case 32 is tipped at a permissible value of $\alpha$ 74, the center of gravity 34 is in front of the supporting wheels 38, and $\beta=45°$.

In general, we would desire that the user never be required to exert more force on the case in rolling it than he would if he lifted it to carry. In other words, we require that $F\leqq W$. The condition of F=W will occur for $\beta=30°$ since equation (1) simplifies in this case to $F=W\cos\alpha((d/h)-\tan\alpha)$. As $\alpha\rightarrow 0°$, $F\rightarrow W(d/h)$ and assuming that $d/h\leqq 1$, $F\leqq W$ for any condition where the case 32 is tipped at a permissible value of $\alpha$ 74, the center of gravity 34 is in front of the supporting wheels 38, and $\beta=30°$.

Thus, it can be seen that as $\beta$ 78 increases, the maximum amount of force, F, 76 to be exerted by a user 56 decreases. Since $\beta\leqq 90°-\tan^{-1}(d/h)$, the maximum value of $\beta$ 78 for which F 76 is also a minimum is $90°-\tan^{-1}(d/h)$.

A prototype wheeled case constructed by the applicant had a value of $d/h\approx 9$ inches/28 inches=9/28 and a $\beta\approx 40°$. Thus, the maximum angle of tip for the prototype case where the center of gravity would remain over the wheels would be $\alpha \approx \tan^{-1}(9/28) \approx 17.8°$. For the values of $\alpha$=15°, 10°, 5°, and 0°, we obtain the following table of values of $\alpha$ 74 and F 76 using equation (1):

| $\alpha$ | F |
|---|---|
| 15° | 0.0402 W |
| 10° | 0.1112 W |
| 5° | 0.1813 W |
| 0° | 0.2500 W |

For the prototype wheeled case, an optimal $\beta$, insofar as minimizing the value of F 76 is concerned, is: $\beta = 90° - \tan^{-1}(9/28) \approx 72.2°$.

Figure 9:
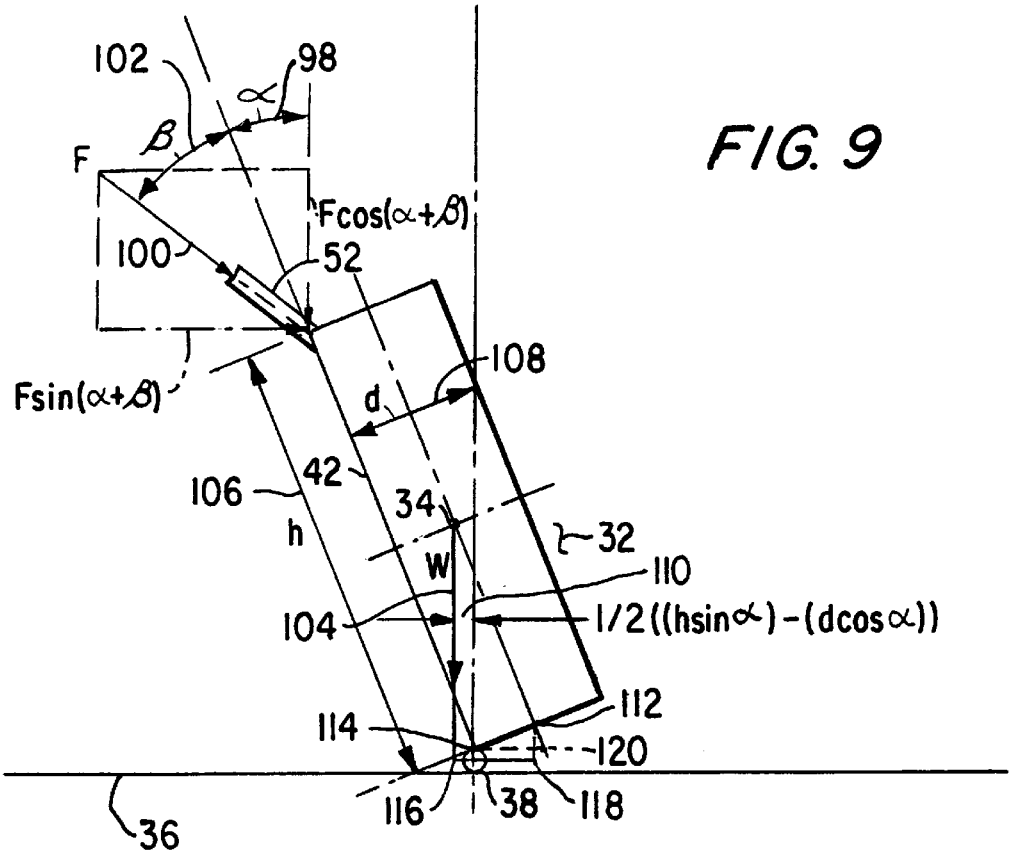
FIG. 9 is a simplified force diagram of an inclined handled case tipped so that the center of gravity of the case is in back of the supporting wheels.

FIG. 9 shows a simplified force diagram for the situation obtaining when case 32 is tipped at an counterclockwise angle, $\alpha$, 98 relative to the horizontal (assumed to be positive; $\alpha$=0° corresponds to an untipped state which is a limiting condition since the case 32, which has fixed supports 50, cannot be rolled upright) such that the horizontal position of the center of gravity 34 is in back of the wheels 38. (In all calculations below, the simplifying assumption is made that the diameter of the wheels 38 is negligible compared to the other dimensions of the case 32 and, thus, that diameter is ignored. This assumption is reasonable for wheeled cases conventional in the art.) The pushing force F 100 is assumed to be exerted by the user 56 along the axis of the inclined handle 52. The inclined handle 52 is inclined at a counterclockwise angle, $\beta$, 102 (assumed to be positive; $\beta$=0° corresponds to the condition of a parallel handle) with respect to the rear wall 42 of the case 32. The weight of the case 32, W, 104 acts through the center of gravity 34. The case 32 has a height, h, 106 and a depth, d, 108.

Figure 9A:
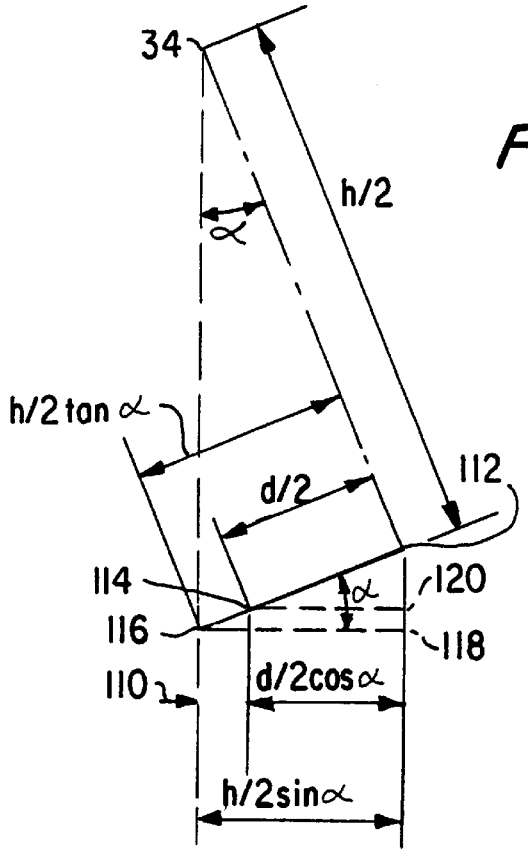
FIG. 9A is an enlargement of a portion of FIG. 9.

The expression for the horizontal distance between the center of gravity 34 and the center of the wheels 38, $\frac{1}{2}((h \sin \alpha)-(d \cos \alpha))$, 110 was derived by using the similar triangles shown in FIG. 9A which is an enlargement of like similar triangles in FIG. 9. The vertices of the triangles in FIGS. 9 and 9A have been identically labelled 34 (also the center of gravity), 112, 114, 116, 118, 120 to assist a reader of ordinary mathematical skill to follow the derivation from the FIGures. For the center of gravity 34 to be in back of the wheels, we require that $\frac{1}{2}((h \sin \alpha)-(d \cos \alpha))>0$ which simplifies to $d/h<\tan \alpha$.

In order to assure rotational stability about the wheels 38, or in another words to assure that the case 32 does not tip over in either direction while rolling on the wheels, the moments of F 100 and W 104 about the wheels 38 must sum to zero. Expressing this in equation form, we obtain:

$$-(F \sin(\alpha+\beta)h \cos \alpha)+(F \cos(\alpha+\beta)h \sin \alpha)+[W \tfrac{1}{2}((h \sin \alpha)-(d \cos \alpha))]=0$$

Solving for F 100 and simplifying, we obtain:

$$F=[(W/2)(\cos \alpha)(\tan \alpha-(d/h))]/\sin \beta \quad (2)$$

which is precisely the negative of the expression for F obtained in equation (1) and which can also be expressed as:

$$F=[(W/2)(\sin \alpha-(\cos \alpha(d/h)))]/\sin \beta \quad (3)$$

The condition of $\tan \alpha > d/h$ implies that $\alpha > \tan^{-1}(d/h)$ and $0° < \tan^{-1}(d/h) \leqq 45°$ because $0 < d/h \leqq 1$.

The conclusions previously stated for $\beta$=0° and $\beta \neq 0°$ in the case of the center of gravity 34 being in front of the wheels 38 apply equally in this analysis when the center of gravity 34 is in back of the wheels 38. Furthermore, as in the previous analysis, the user would desire that $0° < \beta \leqq 90° - \alpha$. The condition of $\beta \leqq 90° - \alpha$ implies that $\alpha \leqq 90° - \beta$.

Both of the conditions of $0° < \beta \leqq 90° - \alpha$ and $\tan^{-1}(d/h) < \alpha \leqq 90° - \beta$ being true imply that $0° < \beta < 90° - \tan^{-1}(d/h)$ which is essentially the same permissible range for $\beta$ derived in the previous force analysis. For the situation where $0° < \beta < 90° - \tan^{-1}(d/h)$ and $\tan^{-1}(d/h) < \alpha < 90° - \beta$, $\tan^{-1}(d/h)$ having the range $0° < \tan^{-1}(d/h) \leqq 45°$, it can be seen from equation (2) that F 100 will always be positive, thus validating our original assumption of F 100 as a pushing force. In addition, for a constant $\beta$ in the range of $0° < \beta < 90° - \tan^{-1}(d/h)$ and for a in the range of $\tan^{-1}(d/h) < \alpha \leqq 90° - \beta$, $\alpha = 90° - \beta$ will produce a greater value of F 100 than any value of $\alpha$ in the remainder of the range of $\tan^{-1}(d/h) < \alpha \leqq 90° - \beta$ as may be seen by an inspection of equation (3).

For $\beta$=60°, equation (3) simplifies to: $F=(W/\sqrt{3})(\sin \alpha-(\cos \alpha(d/h)))$. For $\beta$=60°, a maximum F 100 will be produced when $\alpha = 90° - \beta = 90° - 60° = 30°$. For $\alpha$=30°, $F=(W/\sqrt{3})(\frac{1}{2}-(\sqrt{3}/2(d/h))$ and since $0<d/h<\tan 30°$ or $0<d/h<1/\sqrt{3}$, $F<W/2\sqrt{3} \approx 0.289$ W for any condition where the case 32 is tipped at a permissible value of $\alpha$ 98, the center of gravity 34 is in back of the supporting wheels 38, and $\beta$=60°.

For the condition of $\beta$=45°, equation (3) simplifies to: $F=(W/\sqrt{2})(\sin \alpha-(\cos \alpha(d/h)))$. For $\beta$=45°, a maximum F 100 will be produced at $\alpha = 90° - \beta = 90° - 45° = 45°$. Thus, in this condition $F=(W/2)(1-(d/h))$ and assuming that $d/h \leqq 1$, F<0.500 W for any condition where the case 32 is tipped at a permissible value of ($\alpha$ 98, the center of gravity 34 is in back of the supporting wheels 38, and $\beta$=45°.

In general, we would desire that the user never be required to exert more force on the case in rolling it that he would if he lifted it to carry. In other words, we require that $F \leqq W$. We will determine whether $F \leqq W$ for $\beta$=30° as it was for the previous force analysis. For $\beta$=30°, equation (3) simplifies to $F=W(\sin \alpha-(\cos \alpha(d/h)))$. When $\beta$=30°, F 100 reaches a maximum for $\alpha = 90° - \beta = 90° - 30° = 60°$. At $\alpha$=60°, $F=(W/2)(\sqrt{3}-(d/h))$. Assuming that $d/h \leqq 1$, we obtain that $F<(\sqrt{3}/2)W \approx 0.866$ W<W for any condition where the case 32 is tipped at a permissible value of $\alpha$ 98, the center of gravity 34 is in back of the supporting wheels 38, and $\beta$=30°.

Thus, as in the previous force analysis, as $\beta$102 increases, the maximum amount of force F 100 to be exerted by a user decreases, and the maximum value of $\beta$102 which minimizes F 100 is $90° - \tan^{-1}(d/h)$.

For the prototype wheeled case constructed by the applicant and for the values of $\alpha$=50°, 45°, 40°, 35°, 30°, 25°, and 20°, we obtain the following table of values of $\beta$ and F using equation (3):

| $\alpha$ | F |
|---|---|
| 50° | 0.4352 W |
| 45° | 0.3732 W |
| 40° | 0.3085 W |
| 35° | 0.2414 W |
| 30° | 0.1724 W |
| 25° | 0.1021 W |
| 20° | 0.0311 W |

From the previous force analyses, we can reach several conclusions. First, rotational stability for the inclined handled case can be achieved with only axial force being applied to the handle over a large range of angles of tip, $\alpha$. The range of angles of tip is limited by the desirability of the handle being at least horizontal for any given $\alpha$ and the angle of the handle with respect to the rear of the case, $\beta$. With respect to the applicant's prototype, for example, an angle of tip from 0° to 50° was permissible, given the constraint of keeping the handle horizontal. This rotational stability contrasts with the conventional parallel handled case where we demonstrated that axially directed force along the handle would only assure rotational stability for an angle of tip such that the center of gravity was over the wheels.

Second, the first force analysis for the center of gravity in front of the wheels showed that, for angles of inclination of the handle, β, 78 of at least 30°, the pulling force F 76 exerted by the user to achieve rotational stability did not exceed the weight of the case. Moreover, to minimize F 76, a value of β102 of $90°-\tan^{-1}$ (d/h) was derived. The second force analysis for the center of gravity in back of the wheels likewise showed that, for $\beta \geqq 30°$, the pushing force F 100 to be exerted by the user to achieve rotational stability did not exceed the weight of the case. An optimal value of β102 of $90°-\tan^{-1}$ (d/h) to minimize F 100 was found which was the same as the value from the first force analysis.

The use of $\beta=90°-\tan^{-1}$ (d/h) will, however, eliminate the existence of any angle of tip, α, at which the case can be pushed rather than pulled since once $\alpha=\tan^{-1}$ (d/h), the point at which the center of gravity of the case is over the wheels, $\beta+\alpha=90°$ and the handle has already reached the assumed maximum horizontal position. Thus, to maximize β, while allowing the angular range over which pushing is effective to be as large as that over which pulling is effective, β should be set at a maximum of $90°-(2\tan^{-1}$ (d/h)). When β is set to this value, both of the angular ranges for pulling and pushing will be equal to $\tan^{-1}$ (d/h), and $\tan^{-1}$ (d/h) is the maximum angular range for pulling in any event, which can be seen from the first force analysis. For the applicant's prototype, this maximum angle becomes $\beta=90°-2\tan^{-1}(9/28)\approx 54.4°$.

Thus, the combination of both analyses indicate a preferable range for the angle at which the inclined handle is set of 30° to $90°-(2\tan^{-1}$ (d/h)), assuming that $90°-(2\tan^{-1}$ (d/h)) is greater than 30°. If this assumption is not true, then an angle of approximately 30° is preferable. The angle selected is, of course, a function also of the dimensions of the case, the handle, and the comfort of the user.

Figure 10:
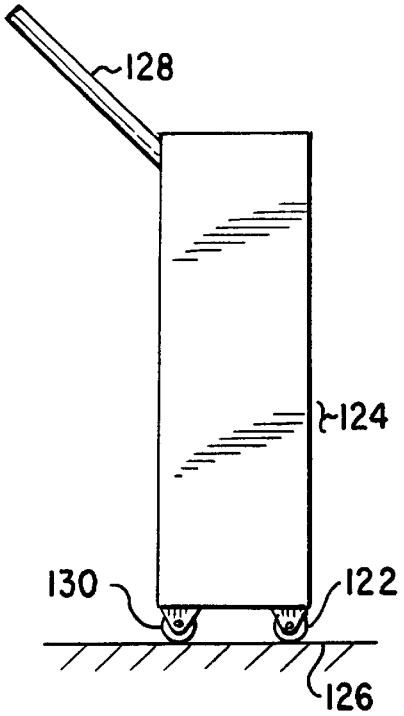
FIG. 10 is a side elevation view of a third embodiment of the invention.
Figure 12:
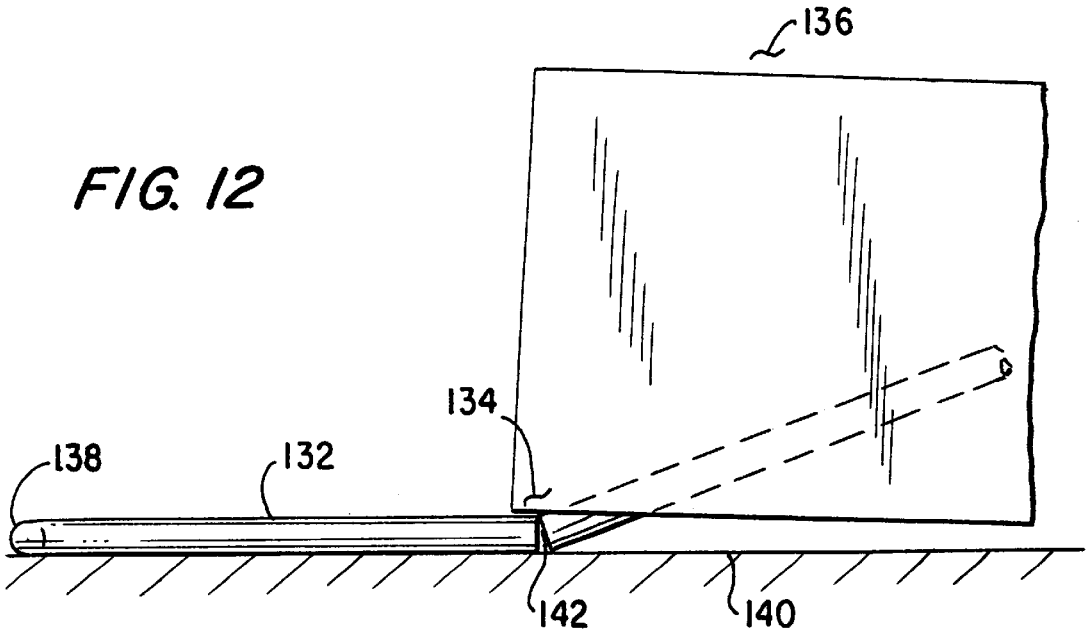
FIG. 12 is an enlarged portion of FIG. 11 showing the wheeled case in a fallen position with a portion of the inclined handle lying flat on a supporting surface.

FIG. 10 shows a third embodiment of the invention which differs from the first embodiment of the invention insofar as the fixed supports 50 are replaced by front wheels 122 mounted on swivelling attachments or equivalent devices which allow the front wheels 122 to rotate about their vertical axes. The front wheels 122 allow rolling of the case 124 in the vertical position. When it is desired to push or pull the case 124 in the vertical position, it may be necessary for the user to lift the front wheels 122 and the case 124 slightly from the supporting surface 126, while setting the case in motion by pushing or pulling on the handle 128 when the case 124 is on carpet, very rough floors, or an equivalent irregular surface. This will insure that the back wheels 130 begin turning immediately and the front wheels 122 rotate to a position parallel to the desired direction of travel while elevated and begin turning immediately on recontacting the surface 126 which will prevent any possibility of the case 124 overturning on being pushed or pulled by the handle 128.

Figure 11:
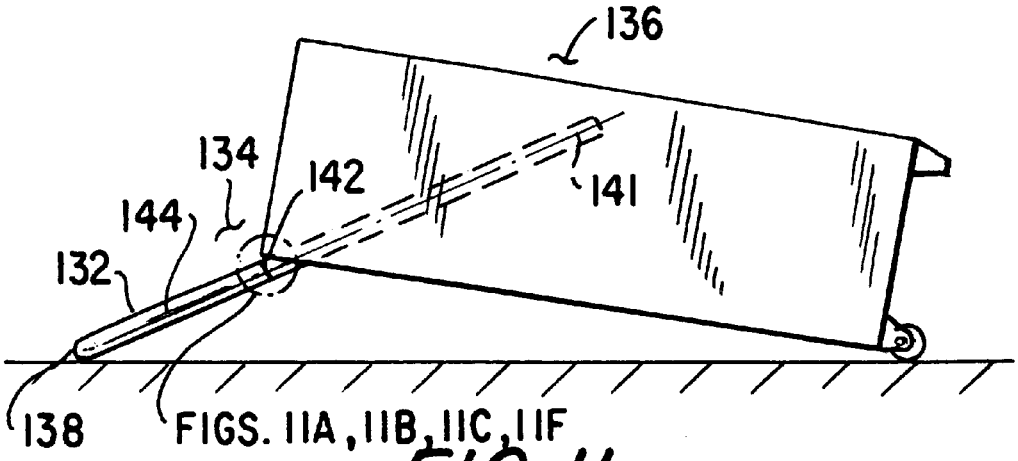
FIG. 11 is a side elevation view of a fourth embodiment of the invention with the wheeled case in a fallen position supported by the inclined handle.

FIG. 11 shows a fourth embodiment of the invention which differs from the first embodiment of the invention in that it entails a design of the legs 132 of the inclined U-shaped telescoping handle 134 to prevent breakage of the inclined U-shaped telescoping handle 134 if the wheeled case 136 falls as shown in FIG. 11. In FIG. 11, the wheeled case 136 is depicted in a position where it has fallen so that the legs 132 and the member 138 of the inclined U-shaped telescoping handle 134 spanning the legs 132 support the case 136, the member 138 resting on the supporting surface 140. The handle 134 is in its fully extended position.

As can be well imagined, wholly rigid legs could easily break upon impact of the member 138 with the supporting surface 140. To decrease the probability of such an event, the legs 132 have been designed to allow them to rotate, in at least one location, out of their longitudinal axes 141 when the legs 132 are straight, thus reducing the chance that the legs 132 will break at another location. To allow the necessary rotation, the legs 132 are cut preferably at a location 142 adjacent to the location at which the legs 132 enter the wheeled case 136 when the inclined U-shaped telescoping handle 134 is fully extended. When the inclined U-shaped telescoping handle 134 is fully extended, maximum bending stress will be placed on it in the event the wheeled case falls as shown due to the maximum length of the handle 134 at full extension. In such a condition, the points of highest bending stress on the portion of the inclined U-shaped telescoping handle 134 which is extended will be adjacent to location 142. Thus, location 142 is a preferable place for the cut in the legs 132 as this is the place a break is most likely to occur when the handle 134 is fully extended.

When the handle 134 is not fully extended, the bending stress on the legs 132 in the position of the wheeled case 136 and the handle 134 shown in FIG. 11 will be lower than for the condition of full extension of the handle 134, with the maximum bending stress still occurring immediately adjacent to the point at which the legs 132 enter the wheeled case 136. Since this point will correspond to a different location on the legs 132 for every degree of extension, an optional additional cut in the legs 132 may be made at location 144 substantially at the midpoint of the portion of the legs 132 extending beyond the wheeled case 136 when the handle 134 is fully extended. This optional additional cut at location 144 most advantageously provides for the condition of a partially extended handle 134 with as few additional cuts in the legs 132 as possible.

Figure 11A:
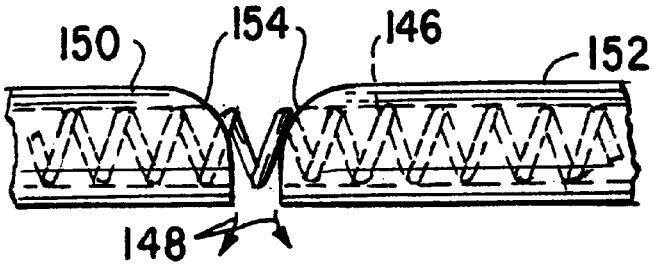
FIG. 11A is a first detailed embodiment of the portion of FIG. 11 indicated therein.

Several different alternatives for the actual arrangement to allow rotation of the legs 132 exist. In FIG. 11A, a first alternative is shown comprising a spring 146 loaded in the interior of the legs 132. The arrows 148 show the direction of rotation of the cut pieces 150, 152 of the legs 132 when impact of the handle 134 with the supporting surface 140 occurs. In order to minimize the actual separation of the cut pieces 150, 152 of the legs 132 when assembled while still allowing the necessary rotation of the cut pieces 150, 152 when impact occurs, the top portions 154 of the edge of the cut pieces 150, 152 are cut back in a circular fashion to prevent interference of the top portions 154 when the cut pieces 150, 152 rotate. Alternatively, it may be possible to dispense with cutting back the top portions 154 of the edge of the cut pieces 150, 152 in a circular fashion since the spring 146 may be sufficiently elastic to allow the cut pieces 150, 152 to rotate about the uncut edges of the top of each cut piece 150, 152.

Figure 11B:
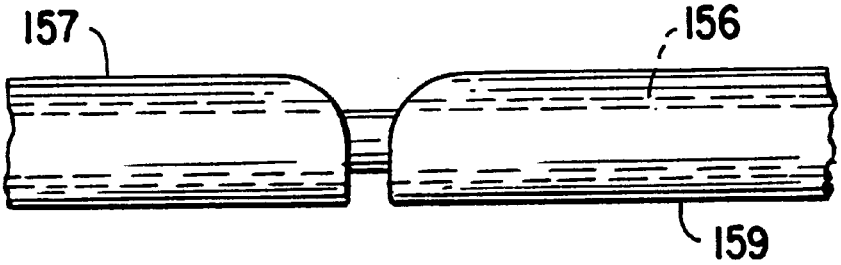
FIG. 11B is a second detailed embodiment of the portion of FIG. 11 indicated therein.

In FIG. 11B, a second alternative is shown which substitutes a flexible polyvinyl chloride (PVC) rod 156 for the spring 146 in FIG. 11A. The PVC rod 156 is fastened to the interior of each leg 132 spanning the cut in each leg 132. The fastening means comprise pins or other conventional means. The PVC rod is preferably of a smaller diameter than the interior diameter of the legs 132 to furnish an allowance for rotation of the cut pieces 157, 159 of the legs 132 upon impact before the PVC rod 156 is bent by such impact.

In FIG. 11C, a third alternative is shown which employs a pin 158 to permit the cut pieces 162, 166 of each of the legs 132 to rotate about the pin 158. The pin 158 is mounted from twin brackets 160 which are attached to one cut piece 162 of leg 132. The free ends 164 of the brackets 160 are located outside the exterior diameter of the other cut piece 166. The pin 158 passes through the other cut piece 166 and the portion of the brackets 160 adjacent to the free ends 164. The pin 158 offers sufficient frictional resistance against the rotation of the two cut pieces 162, 166 to prevent such rotation on ordinary use of the wheeled case 136, but allows such rotation when a substantial force is applied to the legs 132 in a direction normal to the longitudinal axes 141 of the legs 132, when the legs 132 are straight, such as when the wheeled case 136 falls to a supporting surface 140 in the position shown in FIG. 11.

This third alternative design may optionally be enhanced by providing a locking device as shown in FIG. 11E to insure that the legs 132 remain straight in ordinary use. The locking device comprises a tongue 170 which is biased by a spring 168, the spring 168 being attached to the interior wall of the cut piece 166. The spring 168 and the tongue 170 are guided by and move longitudinally within a tube 171 attached to the interior wall of the cut piece 166. The tongue 170 fits within a groove 172 in the pin 158 when the pin 158 is in a position corresponding to the legs 132 being straight. The force exerted by the spring 168 on the tongue 170 seating the tongue 170 in the groove 172 offers additional resistance to a force exerted on the legs 132, normal to the longitudinal axes 141 of the legs 132, causing rotation of the cut piece 166 relative to the other cut piece 162, when compared to a design with no spring 168, tongue 170, and groove 172 being present since these components tend to keep the pin 158 from rotating when the legs 132 are straight.

In FIG. 11F, a fourth alternative is shown which comprises a hinge 174, which is pinned or attached by other conventional means to each cut piece 176, 178, and a bracket 180 rigidly attached to a first one of the cut pieces 176. The free end 182 of the bracket 180, during normal operation of the handle 134 when the cut pieces 176, 178 are collinear, is locked to prevent rotation of the cut pieces 176, 178 by dual springs 184 biasing dual tongues 186, the dual springs 184 being attached to each side 188, 190 of the bracket 180. The dual tongues 186 are seated within dual grooves 192 in the interior wall of the second one of the cut pieces 178 during normal operation of the handle 134. A sufficient force exerted on the legs 132, normal to the longitudinal axes 141 of the legs 132, will overcome the force exerted by the dual springs 184 on the dual tongues 186 and cause the tongues 186 to become unseated from the dual grooves 192, thereby allowing rotation of the cut pieces 176, 178 about the hinge 174. The second one of the cut pieces 178 is cut away sufficiently along its bottom in a region 194 to allow the free end 182 of the bracket 180 to rotate downward without interfering with the second one of the cut pieces 178.

In any event, of course, the magnitude of force exerted on the legs 132 normal to the longitudinal axes of the legs 132 necessary to cause rotation of the cut pieces 162, 166 must not be so high that the normal force causes breakage of the legs 132 before rotation of the cut pieces 162, 166 occurs.

While preferred embodiments have been described herein, it will be understood by those with ordinary skill in the art that various modifications, changes, or alterations may be made to the invention disclosed and described herein without departing from its scope or its equivalent as claimed in the appended claims.

For example, it should be understood that the U-shaped telescoping handle disclosed herein as the inclined handle is exemplary only and that a linear handle could easily be substituted as the inclined handle to be employed. Moreover, the embodiments shown had the inclined handle 52 mounted on the side walls 48 of the case 32, thereby only allowing movement in the two collinear directions parallel to the side walls 48 of the case 32. It should be understood that an inclined handle could be mounted on the front wall 40 and the rear wall 42 of the case, thereby allowing the case to be wheeled in either of the two collinear directions parallel to the front and rear walls of the case, provided that sufficient and properly placed wheels are present on the case.

Other modifications too numerous to mention will easily occur to one of ordinary skill in the art.

What is claimed is:

1. An inclined handle structure for a wheeled case, said wheeled case having walls which are all rectangular, said wheeled case being supported by support elements comprising at least wheels such that said wheeled case is in a position perpendicular to a surface on which said wheels are resting when said wheeled case is an untipped position, said inclined handle structure comprising:

a handle attached at a fixed angle measured counterclockwise from an imaginary line collinear with and extending above a rear wall of said wheeled case and capable of extending from and retracting toward said wall of said wheeled case, said handle being cut in at least one location along said handle, said cut being made substantially normal to a longitudinal axis of said handle and extending completely through said handle, thereby dividing said handle into at least two pieces, each two adjacent pieces of said at least two pieces being connected to each other by means for fastening said two adjacent pieces;

means for guiding said handle while said handle is being extended from and retracted toward said wheeled case; and means for fixedly attaching said means for guiding said handle to said wheeled case;

at least two of said wheels being located on a side of a bottom wall of said wheeled case where said rear wall meets said bottom wall.

2. An inclined handle structure for a wheeled case as claimed in claim 1, wherein said handle is U-shaped, legs of said handle being mounted in said means for guiding said handle, and a linear element of said handle spanning said legs, said linear element being coplanar with said legs, said cut being made in each of said legs.

3. An inclined handle structure for a wheeled case as claimed in claim 1, wherein said handle is U-shaped, legs of said handle being mounted in said means for guiding said handle, and a linear element of said handle spanning said legs, said linear element being in a plane outside a plane of said legs, said cut being made in each of said legs.

4. An inclined handle structure for a wheeled case as claimed in claim 1, wherein a depth dimension, d, of said wheeled case, said depth dimension being measured between a front wall and said rear wall of said wheeled case, is less than or equal to a height dimension, h, of said wheeled case, said height dimension being measured between a top wall and said bottom wall of said wheeled case.

5. An inclined handle structure for a wheeled case as claimed in claim 4, wherein said fixed angle is between 30° and $(90°-(2\tan^{-1}(d/h)))$.

6. An inclined handle structure for a wheeled case as claimed in claim 4, wherein said fixed angle is approximately 30°.

7. A method for using an inclined handle structure for a wheeled case as claimed in claim 4, comprising the steps of:

a. extending said handle to its full length;

b. tipping said wheeled case back on said at least two of said wheels in the same direction that said handle was extended, said tipping producing an angle of said wheeled case with a perpendicular direction to said surface such that a center of gravity of said wheeled case is in front of said at least two of said wheels, said angle further being such that a grasped end of said handle is at least as high as a portion of said handle at a point of attachment to said wheeled case; and c. pulling said handle, thereby propelling said wheeled case toward a user pulling said handle.

8. A method for using an inclined handle structure for a wheeled case as claimed in claim 4, comprising the steps of:

a. extending said handle to its full length;

b. tipping said wheeled case back on said at least two of said wheels in the same direction that said handle was extended, said tipping producing an angle of said wheeled case with a perpendicular direction to said surface such that a center of gravity of said wheeled case is in back of said at least two of said wheels, said angle further being such that a grasped end of said handle is at least as high as a portion of said handle at a point of attachment to said wheeled case; and c. pushing said handle, thereby propelling said wheeled case away from a user pushing said handle.

9. An inclined handle structure for a wheeled case as claimed in claim 1, wherein said means for guiding said handle surrounds said handle.

10. An inclined handle structure for a wheeled case as claimed in claim 1, wherein said means for guiding said handle is located inside said walls of said wheeled case.

11. An inclined handle structure for a wheeled case as claimed in claim 1, wherein said means for fixedly attaching said means for guiding said handle to said wheeled case is located within said walls of said wheeled case.

12. An inclined handle structure for a wheeled case as claimed in claim 1, wherein said support elements comprise fixed supports.

13. An inclined handle structure for a wheeled case as claimed in claim 1, wherein said means for fastening comprises a spring enclosed within said handle, said spring spanning across said cut.

14. An inclined handle structure for a wheeled case as claimed in claim 1, wherein said means for fastening comprises a flexible rod enclosed within said handle, said flexible rod spanning across said cut.

15. An inclined handle structure for a wheeled case as claimed in claim 1, wherein said means for fastening comprises dual brackets, said dual brackets being attached to a first of said two pieces, and a pin, said pin passing through a second of said two pieces and being mounted on said dual brackets.

16. An inclined handle structure for a wheeled case as claimed in claim 15, wherein a groove is cut into said pin, and a spring-biased tongue is mounted on said second of said two pieces, said spring-biased tongue being seated in said groove when said handle is in an operating position.

17. An inclined handle structure for a wheeled case as claimed in claim 1, wherein said means for fastening comprises a hinge attached to said two pieces and a bracket rigidly attached to a first of said two pieces and lockably attached to a second of said two pieces.

18. An inclined handle structure for a wheeled case as claimed in claim 17, wherein said lockable attachment of said bracket to said second of said two pieces comprises a plurality of springs biasing an equal number of tongues, each of said plurality of springs being attached to one of dual sides of said bracket, and a plurality of grooves equal in number to said plurality of springs and tongues, said plurality of grooves being in said second of said two pieces, said tongues being seated in said grooves when said two pieces are collinear.

* * * * *